United States Patent [19]

Koike et al.

[11] Patent Number: 4,725,849

[45] Date of Patent: Feb. 16, 1988

[54] PROCESS FOR CLOTH PRINTING BY INK-JET SYSTEM

[75] Inventors: Shoji Koike; Kazuo Iwata, both of Yokohama, Japan

[73] Assignee: Canon Kabushiki Kaisha, Tokyo, Japan

[21] Appl. No.: 899,612

[22] Filed: Aug. 25, 1986

[30] Foreign Application Priority Data

Aug. 29, 1985 [JP] Japan ..... 60-188415
Aug. 29, 1985 [JP] Japan ..... 60-188416

[51] Int. Cl.[4] ..... G01D 15/16

[52] U.S. Cl. ..... 346/1.1; 346/75; 346/140 R; 427/261; 427/288; 427/385.5; 427/394

[58] Field of Search ..... 346/1.1, 75, 140; 427/261, 288, 394, 385.5, 384, 372.2

[56] References Cited

U.S. PATENT DOCUMENTS

| | | | |
|---|---|---|---|
| 4,290,072 | 9/1981 | Mansukhani | 346/1.1 |
| 4,340,893 | 7/1982 | Ort | 346/1.1 |
| 4,538,160 | 8/1985 | Uchiyama | 346/140 |
| 4,542,059 | 9/1985 | Toganoh | 346/135.1 X |
| 4,555,437 | 11/1985 | Tanck | 346/135.1 X |

FOREIGN PATENT DOCUMENTS

| | | | |
|---|---|---|---|
| A1532036 | 11/1978 | United Kingdom | 41/23 |

*Primary Examiner*—Joseph W. Hartary
*Attorney, Agent, or Firm*—Fitzpatrick, Cella, Harper & Scinto

[57] ABSTRACT

A process for printing a cloth with a dye-containing ink by an ink-jet system is provided in which an ink-receiving material with a viscosity of 1000 cp or higher at 25° C. is applied onto the cloth prior to the printing. The ink-receiving material may be a water-soluble resin-containing solution or a hydrophilic resin-containing solution.

5 Claims, 4 Drawing Figures

FORMATION OF INK-RECEIVING LAYER

JET PRINTING

FIXING

SOAPING

PROCESS FOR CLOTH PRINTING BY INK-JET SYSTEM

BACKGROUND OF THE INVENTION

1. Field of the Invention

The present invention relates to a process for printing a cloth by an ink-jet system, and more particularly to a process for printing a cloth by utilizing the ink-jet system, characterized in that the fabrics to which inks will be applied are subjected to a specific pretreatment.

2. Related Background Art

Printing method such as roller printing, screen printing, transfer printing, etc. have been employed for printing cloths such as woven fabrics, nonwoven fabrics, and blended woven fabrics. Lately further, printing methods by means of ink-jet printing systems are proposed.

In conventional printing methods, printing plates have to be fabricated such as printing drums and screen plates, and it will be expensive. Moreover, in transfer printing, the preparation of the plates for printing transfer paper also will be expensive. Consequently, conventional printing methods are economical only in mass production exceeding a certain level of printing scale. Short life of a design for a printed cloth due to short life of fashion necessitates a renewal of the printing plates to meet the change of the fashion, and it may possibly result in large stocks of printed cloths, which necessarily results in further cost-up, and such has been a great problem. An ink-jet system was proposed to soslsve such problem. However, it cannot give sufficiently precise printed pattern on woven fabrics because of the slow rate of ink absorption due to the characteristics of a conventional printing paste, tendency of spreading of the applied ink due to the presence of weave in textile, low surface smoothness of the woven fabric, and lack of permanence dyeing even when a dye fixing treatment is used.

SUMMARY OF THE INVENTION

Accordingly, the primary object of the present invention is to provide a process for textile printing by the ink-jet system, said process being capable of solving such economic problems as states above in the general textile printing processes hitherto practiced as well as difficulties in achieving precise prints by the hitherto proposed textile printing processes based on the ink-jet system.

According to an aspect of the present invention, there is provided a process for printing a cloth with a dye-containing ink by an ink-jet system, an ink-receiving material with a viscosity of 1000 cp or higher at 25° C. being applied onto the cloth prior to the printing.

According to another aspect of the present invention, there is provided a process for printing a cloth with an aqueous ink containing a water-soluble dye or a disperse dye by an ink-jet system, a water-soluble resin-containing solution or a hydrophilic resin-containing solution with a viscosity of 1000 cp or higher at 25° C. being applied in a layer or layers onto the cloth prior to the printing.

DETAILED DESCRIPTION OF THE PREFERRED EMBODIMENTS

The principal characteristic of the present invention is to use such pretreated cloth in the printing process based on the ink-jet system that the surface of cloth to be printed is previously provided with an ink-receiving material which comprises a hydrophilic resin solution and capable of readily and quickly receiving and absorbing inks or recording liquids used in the ink-jet system, the viscosity of said ink-receiving material at 25° C. being regulated to at least 1000 cp.

Cloths for use in the present invention are; those made of one kind of fiber selected from natural fibers including cotton, wool, silk, hemp, etc., and from synthetic fibers including acrylic fibers, nylon fibers, and the like which are all dyeable with water-soluble dyes; and blended fabrics made of different kinds of fibers cited above or made of fibers cited above with other fibers, for example, polyester fibers, vinylon fibers, polypropylene fibers, and acetate rayon. In the present invention, these cloths or the fibers constructing these cloths are previously given an ink-receiving material which comprises a hydrophilic resin solution and can receive and absorb readily and quickly inks for ink-jet system purposes. The ink-receiving material referred to in the present invention has a viscosity which has been regulated to at 1000 cp at 25° C.

The present inventors have accomplished the present invention on the basis of finding that the above-mentioned drawbacks of the prior art, particularly the problems arising from the use of a low-viscosity aqueous ink in the ink-jet system, can be readily solved by forming a layer having such performance characteristics and physical properties as stated above on the fabric to be printed.

The preferable materials for the above ink-receiving materials include a water-soluble or hydrophilic natural or synthetic compounds. Preferred specific examples of the compounds are natural resins including albumin, gelatin, casein, starch, cationic starch, gum arabic, and sodium alginate; and synthetic resins including water-soluble polyamide, polyacrylamide, polyvinylpyrrolidone, quaternary salts of polyvinylpyrrolidone, polyethyleneimine, polyvinylpyridinium halides, melamine resin, polyurethane, carboxymethylcellulose, polyvinyl alcohol, cation-modified polyvinyl alcohol, water-soluble polyester, and poly(soduim acrylate). These polymers may be used alone or in combination as desired. Moreover, for the purpose of reinforcing the ink-receiving material and/or enhancing its adhesion to the base material, there may optionally be used jointly a resin such as an SBR latex, NBR latex, polyvinyl formal, polymethyl-methacrylate, polyvinyl-butyral, polyacrylonitrile, polyvinyl-chloride, polyvinyl-acetate, phenolic resin, or alkyd resin.

Figure 1:
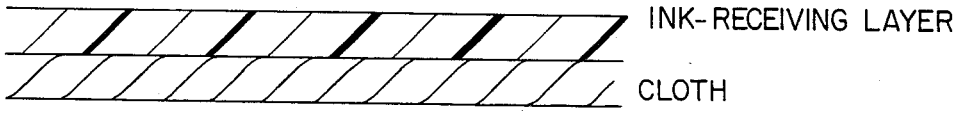
FIGS. 1-1 to 1-4 illustrate an embodiment of the cloth printing process of the present invention.

Such an ink-receiving material is formed by dissolving or dispersing one or more of the above-cited polymers in a suitable solvent such as water to prepare a treating liquid, and treating the cloth with this treating liquid by any of known methods, e.g. dipping, spraying, roll coating, rod bar coating, and air-knife coating (see FIG. 1-1).

This treatment may be conducted preliminarily or just prior to the printing.

The thus formed ink-receiving material layer may have any thickness that is sufficient to accept inks. In other words, there is no particular restriction on the thickness of this layer provided that the thickness is 0.1 μm or more, though the preferable thickness depends upon the quantity of ink used per unit area. Preferably the thickness is in the range of 0.5 to 30 μm for practical use.

Figures 1, 2:
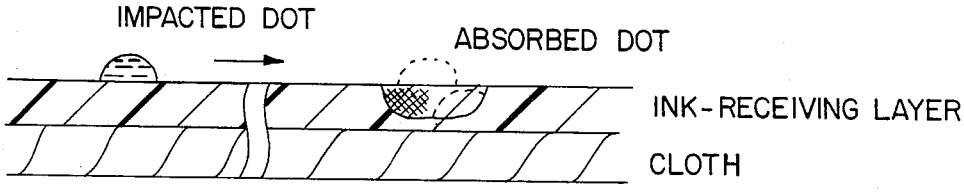

At the time of printing, the ink-receiving material layer is more desirably in a somewhat moist state than in a completely dry state. In the present invention, the ink-receiving material layer when having a certain degree of fluidity will absorb ink very rapidly and in particular enable continuous printing operation. For instance, the above-mentioned treating liquid is applied continuously to the fabric to be printed, before it is fed to an ink-jet printer, and the cloth in an incompletely dry state is fed to the printer to be printed and then is wound up around a winding roll or the like. The ink-receiving material layer absorbs the ink quickly and does not caue feathering (see FIG. 1-2). Even when the printed cloth is wound up into a roll form or portions of the printed cloth are laid one over another, no ink is observed to be transferred to other portion of the cloths. The ink-receiving material layer in such a state contains less than about 80% by weight of water and has a viscosity of at least 1000 cp, preferably from about 3,000 to about 15,000 cp, at 25° C. It has been found that, when the water content exceeds about 80% by weight or the viscosity at 25° C. is less than 1000 cp, the applied ink may spread or adhere to other portions of the cloth and hence continuous operation of the printing will be difficult. Such adjustment of the water content of the fluidity can be achieved easily by controlling the degree of drying of applied ink-receiving material.

A filler may be dispersed in the ink-receiving material for improving ink absorption ability. Such fillers include, for example, silica, clay, talc, diatomaceous earth, calcium carbonate, calcium sulfate, barium sulfate, aluminum silicate, synthetic zeolite, alumina, zinc oxide, lithopone, and satin white.

By applying a specific fluid ink-receiving material as described above on a surface of cloth, inks applied thereto by the ink-jet system are absorbed therein in several seconds so that no ink dot spread excessively on the cloths and hence precise printing is realized through the subsequent fixing treatment. Moreover, quick absorption of the applied ink will prevent the staining of other portion brought into contact with the printed surface, thus allowing the cloths to be piled up or wound up immediately after printing. Consequently, continuous operation of the printing is made feasible and the printed cloths can be stored in arbitrary form until the subsequent fixing treatment.

On the contrary, ink-jet systems of prior art cannot give precise pattern of the print due to excessive feathering of the ink dots since inks for ink-jet printing are aqueous and less viscous and on the other hand the fibers constituting the cloths such as nylon, wool, silk and cotten have smooth surface and not always have sufficient hydrophilicity and further the cloths have weave textures. Moreover, these cloths do not have sufficient hydrophilicity even if the cloths are made from hydrophilic cotton, so that the cloths cannot always absorb ink in such a short time as a few seconds, and cannot suppress the transfer of ink to the other portion brought into contact with the printed portion of the cloths. Fibers other than cotton are much less hydrophilic. The handling of cloths such as winding-up of the cloth immediately after the printing have been difficult. Such difficulties in the prior art can satisfactorily be solved by the present invention.

Any of known dyes of inks for the ink-jet system can be used in the present invention. However, it is desirable to select dyes depending upon the kind of fiber constructing the cloth to be printed. For cellulosic fibers, e.g. cotton, hemp, and viscose, there may used direct dyes, reactive dyes, sulfide dyes in reduced forms, naphthol dyes, vat dyes in reduced forms, and soluble vat dyes. Particularly preferred dyes are as follows:

Direct Dyes:

C.I. Direct Yellow 8, 9, 11, 12, 27, 28, 29, 33, 35, 39, 41, 44, 50, 53, 58, 59, 68, 86, 87, 93, 95, 96, 98, 100, 106, 108, 109, 110, 130, 132, 142, 144, 161, 163, C.I. Direct Orange 6, 15, 18, 26, 29, 34, 37, 39, 40, 41, 46, 49, 51, 57, 62, 71, 105, 107, 115, C.I. Direct Red 2, 4, 9, 23, 26, 31, 39, 62, 63, 72, 75, 76, 79, 80, 81, 83, 84, 89, 92, 95, 111, 173, 184, 207, 211, 212, 214, 218, 221, 223, 224, 225, 226, 227, 232, 233, 240, 241, 242, 243, 247, C.I. Direct Violet 7, 9, 47, 48, 51, 66, 90, 93, 94, 95, 98, 100, 101, C.I. Direct Blue 1, 10, 15, 22, 25, 55, 67, 68, 71, 76, 77, 78, 80, 84, 86, 87, 90, 98, 106, 108, 109, 151, 156, 158, 159, 160, 168, 189, 192, 193, 194, 199, 200, 201, 202, 203, 207, 211, 213, 214, 218, 225, 229, 236, 237, 244, 248, 249, 251, 252, 264, 270, 280, 288, 289, 291, C.I. Direct Green 26, 27, 28, 29, 30, 31, 33, 34, 59, 63, 65, 66, 67, 68, 74, 80, 85, 89, C.I. Direct Brown 44, 98, 100, 103, 106, 113, 115, 116, 157, 169, 170, 172, 195, 200, 209, 210, 212, 221, 222, 223, 227, 228, 229, C.I. Direct Black 9, 17, 19, 22, 32, 51, 56, 62, 69, 77, 80, 91, 94, 97, 108, 112, 113, 114, 117, 118, 121, 122, 125, 132, 146, 154, 166, 173, 199, Kayacelon Red C-HB, Kayacelon Rubin C-BL, Kayacelon Blue C-G, Reactive Dyes:

C.I. Reactive Yellow 2, 3, 13, 14, 15, 17, 18, 21, 23, 24, 25, 26, 27, 29, 34, 35, 37, 39, 41, 42, 49, 50, 52, 54, 55, 57, 58, 63, 64, 69, 75, 76, 77, 79, 81, 82, 83, 84, 85, 87, 88, 91, 92, 93, 95, 96, 98, 111, 115, 116, 125, 127, 131, 135, C.I. Reactive Orange 5, 7, 10, 11, 12, 13, 15, 16, 20, 29, 30, 34, 35, 41, 42, 44, 45, 46, 53, 56, 57, 62, 63, 64, 67, 68, 69, 71, 72, 73, 74, 78, 82, 84, 87, C.I. Reactive Red 3, 13, 17, 19, 21, 22, 23, 24, 28, 29, 35, 37, 40, 41, 43, 45, 49, 55, 56, 58, 63, 65, 66, 67, 78, 80, 81, 82, 83, 84, 85, 86, 87, 100, 104, 106, 108, 109, 110, 111, 112, 113, 114, 117, 116, 118, 119, 120, 123, 124, 126, 128, 130, 131, 132, 136, 141, 147, 154, 158, 159, 170, 171, 172, 174, 176, C.I. Reactive Violet 1, 3, 4, 5, 6, 7, 8, 9, 16, 17, 22, 23, 24, 26, 27, 33, 34, C.I. Reactive Blue 2, 3, 5, 8, 10, 13, 14, 15, 17, 18, 19, 21, 25, 26, 27, 28, 29, 38, 39, 40, 42, 43, 49, 50, 51, 52, 65, 66, 67, 68, 69, 71, 73, 74, 75, 77, 78, 79, 80, 89, 94, 98, 100, 101, 104, 105, 112, 113, 114, 116, 119, 147, 148, 158, 160, 162, 169, 170, 171, 177, 179, 182, 187, C.I. Reactive Green 5, 8, 12, 14, 15, 16, 19, 21, C.I. Reactive Brown 2, 5, 6, 7, 8, 9, 12, 16, 17, 18, 19, 21, 24, 26, 30, C.I. Reactive Black 4, 5, 8, 14, 21, 23, 26, 31, 32, 34, and dyes of Kayacelon React Series (supplied by Nippon Kayaku Co., Ltd.).

The above-cited dyes are also used for blended woven fabrics of cotton with other kinds of fibers.

When the fibers are proteinaceous or of the polyamide type, such as wool, silk, or nylon, there may be used acid dyes, chrome dyes (acid mordant dyes), reactive dyes, vat dyes in reduced forms, soluble vat dyes, sulfide dyes in reduced forms, and naphthol dyes. Particularly preferred dyes of them are as follows:

Acid dyes:

C.I. Acid Yellow 17, 19, 25, 39, 40, 42, 44, 49, 50, 61, 64, 76, 79, 110, 127, 135, 143, 151, 159, 169, 174, 190, 195, 196, 197, 199, 218, 219, 222, 227, C.I. Acid Orange 3, 19, 24, 28:1, 33, 43, 45, 47, 51, 67, 94, 116, 127, 138, 145, 156, C.I. Acid Red 35, 42, 57, 62, 80, 82, 111, 114, 118, 119, 127, 128, 131, 143, 151, 154, 158, 249, 257, 261, 263, 266, 299, 301, 336, 337, 361, 396, 397, C.I. Acid Violet 5, 34, 43, 47, 48, 90, 103, 126, C.I. Acid Blue 25, 40, 41, 62, 72, 76, 78, 80, 82, 92, 106, 112, 113, 120, 127:1, 129, 138, 143, 175, 181, 205, 207, 220, 221, 230, 232, 247, 258, 260, 264, 271, 277, 278, 279, 280, 288, 290, 326, C.I. Acid Green 16, 17, 19, 20, 25, 28, 40, 41, 71, C.I. Acid Brown 4, 248, C.I. Acid Black 7, 24, 29, 48, 52:1, 172

The above-cited reactive dyes are also preferred.

When the fibers are acrylic, the following cationic dyes are preferred.

C.I. Basic Yellow 1, 2, 4, 11, 13, 14, 15, 19, 21, 23, 24, 25, 28, 29, 32, 36, 39, 40, 45, 49, 51, 56, 61, 63, 67, 70, 71, 73, 77, 82, 85, 87, 91, 92, C.I. Basic Orange 21, 22, 27, 28, 29, 30, 36, 40, 42, 43, 44, 46, 47, 57, 58, C.I. Basic Red 12, 13, 14, 15, 18, 22, 23, 24, 25, 27, 29, 35, 36, 38, 39, 45, 46, 51, 52, 54, 59, 60, 61, 68, 69, 71, 74, 75, 78, 80, 81, 82, 95, 100, 102, 103, 104, 109, C.I. Basic Violet 1, 2, 3, 7, 10, 15, 16, 20, 21, 25, 27, 28, 35, 37, 39, 40, 48, C.I. Basic Blue 1, 3, 5, 7, 9, 22, 26, 41, 45, 46, 47, 54, 57, 60, 62, 65, 66, 69, 71, 75, 77, 78, 85, 89, 92, 93, 95, 96, 105, 109, 116, 117, 120, 122, 124, 137, 141, C.I. Basic Green 1, 4, 6, 8, 9, C.I. Basic Brown 14, C.I. Basic Black 8

Disperse dyes can be faborably used when the cloth to be printed is made mainly of synthetic fibers such as polyeter, vinylon, polypropylene, acetate rayon, acrylic, or nylon fibers. Any of known disperse dyes may be used for such fabrics. Particularly preferred dyes of them are as follows:

C.I. Disperse Yellow 3, 4, 5, 7, 9, 13, 24, 30, 33, 34, 42, 44, 49, 50, 51, 54, 56, 58, 60, 63, 64, 66, 68, 71, 74, 76, 79, 82, 83, 85, 86, 88, 90, 91, 93, 98, 99, 100, 104, 114, 116, 118, 119, 122, 124, 126, 135, 140, 141, 149, 160, 162, 163, 164, 165, 179, 180, 182, 183, 186, 192, 198, 199, 202, 204, 210, 211, 215, 216, 218, 224;

C.I. Disperse Orange 1, 3, 5, 7, 11, 13, 17, 20, 21, 25, 29, 30, 31, 32, 33, 37, 38, 42, 43, 44, 45, 47, 48, 49, 50, 53, 54, 55, 56, 57, 58, 59, 61, 66, 71, 73, 76, 78, 80, 89, 90, 91, 93, 96, 97, 119, 127, 130, 139, 142;

C.I. Disperse Red 1, 4, 5, 7, 11, 12, 13, 15, 17, 27, 43, 44, 50, 52, 53, 54, 55, 56, 58, 59, 60, 65, 72, 73, 74, 75, 76, 78, 81, 82, 86, 88, 90, 91, 92, 93, 96, 103, 105, 106, 107, 108, 110, 111, 113, 117, 118, 121, 122, 126, 127, 128, 131, 132, 134, 135, 137, 143, 145, 146, 151, 152, 153, 154, 157, 159, 164, 167, 169, 177, 179, 181, 183, 184, 185, 188, 189, 190, 191, 192, 200, 201, 202, 203, 205, 206, 207, 210, 221, 224, 225, 227, 229, 239, 240, 257, 258, 277, 278, 279, 281, 288, 296, 303, 310, 311, 312, 320, 324, 328

C.I. Disperse Violet 1, 4, 8, 23, 26, 27, 28, 31, 33, 35, 36, 38, 40, 43, 46, 48, 50, 51, 52, 56, 57, 59, 61, 63, 69, 77;

C.I. Disperse Green 9;

C.I. Disperse Brown 1, 2, 4, 9, 13, 19,

C.I. Disperse Blue 1, 3, 7, 9, 14, 16, 19, 20, 26, 27, 35, 43, 44, 54, 55, 56, 58, 60, 62, 64, 70, 72, 73, 75, 79, 81, 82, 83, 87, 91, 93, 94, 95, 96, 102, 106, 108, 112, 113, 115, 118, 120, 122, 125, 128, 130, 139, 141, 142, 143, 146, 148, 149, 153, 154, 158, 165, 167, 171, 173, 174, 176, 181, 183, 185, 186, 187, 189, 197, 198, 200, 201, 205, 207, 211, 214, 224, 225, 257, 259, 267, 268, 270, 284, 285, 287, 288, 291, 293, 295, 297, 301, 315, 330, 333;

C.I. Disperse Black 1, 3, 10, 24,

Kayacelon Red E-GL, Kayacelon Blue E-TB, Kayacelon

Navy Blue E-EX, Kayacelon Black E-EX

When the cloth to be printed is made of a blend of the above-mentioned synthetic fibers with natural fibers, e.g. cotton, silk, hemp, or wool fibers, there may be used dyes for these natural fibers, e.g. direct dyes, acid dyes, chrome dyes (acid mordant dyes), reactive dyes, vat dyes in reduced form, soluble vat dyes, sulfide dyes in reduced forms, and naphthol dyes, jointly with the above-cited disperse dyes.

The ink-jet printing ink used in the present invention is a solution of a dye as cited above in a medium having a dye concentration ranging approximately from 0.1 to 20% by weight. The medium used for the ink is water alone or preferably a mixture of water with a water-soluble organic solvent. Such organic solvents include; $C_1$–$C_4$ alkyl alcohols, e.g. methanol, ethanol, n-propanol, isopropanol, n-butanol, sec-butanol, tert-butanol, and iso-butanol; amides, e.g. dimethylformamide and dimethylacetamide; ketones or keto alcohols, e.g. acetone and diacetone alcohol; ethers, e.g. tetrahydrofuran and dioxane; polyalkylene glycols, e.g. polyethylene glycol and polypropylene glycol; alkylene glycols having 2 to 6 carbon atoms in the alkylene group, e.g. ethylene glycol, propylene glycol, butylene glycol, triethylene glycol, 1,2,6-hexanetriol, thiodiglcol, hexylene glycol, and diethylene glycol; glycerol; lower alkyl ethers of polyhydric alcohols, e.g. ethylene glycol methyl (or ethyl) ether, diethylene glycol methyl (or ethyl) ether, and triethylene glycol monomethyl (or monoethyl) ether; N-methyl-2-pyrrolidone; and 1,3-dimethyl-2-imidazolidinone.

These media can be sued alone or in combination. The most suitable medium compositions are mixtures of water with one or more water-soluble organic solvents comprising at least one of water-soluble high-boiling organic solvents such as polyhydric alcohols, e.g. ethylene glycol, propylene glycol, and glycerol.

To the above stated essential ingredients of the ink composition used in the present invention, there may optionally be added various known dispersants, surfactants, viscosity modifiers, surface tension modifiers, and other kinds of dyes.

Such additives include; viscosity modifiers, e.g. polyvinyl alcohol, cellulosic, and other water-soluble resins; cationic, anionic, or non-ionic surfactants; surface tension modifiers, e.g. diethanolamine and triethanolamine; pH conditioners employing buffer solutions; and fungicides.

In preparation of an ink for ink-jet printing utilizing electrical charging of the ink, an inorganic salt such as lithium chloride, ammonium chloride, and sodium chloride is added as a resistivity regulator to the ink. In inks for ink-jet printing system employing the action of thermal energy for ejecting the ink, thermal properties (e.g. specific heat, thermal expansion coefficient, and thermal conductivity) of the inks may be regulated.

When a disperse dye is used in an ink, the ink is prepared by dispersing the dye in an ink medium so as to give a dye concentration of about 0.1 to 15% by weight.

Any ink-jet system is acceptable in the present invention provided that the system can eject ink compositions effectively from nozzles and apply the ink composition onto a target cloth. Typical ink-jet systems are described, for example, in IEEE Transaction or Industry Applications, Vol. IA-13, No. 1 (Feb.-Mar., 1977) and Nikkei Electronics, issued Apr. 19, 1976, Jan. 29, 1973, and May 6, 1974. Systems described in these documents are well suited for the textile printing process of the present invention. Some of them are explained below. First, there is mentioned an electrostatic attraction system. According to one type of electrostatic systems, recording is carried out by applying a strong electric field between a nozzle and an accelerating electrode positioned several mm ahead of the nozzle to pull out the ink in a particle form the nozzle and to record the information by applying the information signal while the pulled-out ink particles are flying between the deflecting electrodes. According to another type of electrostatic systems, recording is carried out by jetting ink particles in response to an information signal without deflecting the course of ink particles. Both of the systems are useful for the printing process of the present invention.

The second system comprises applying high pressure to an ink by means of a small pump and vibrating mechanically the nozzle by using a quarz oscillator, thereby jetting forcibly fine particles of the ink, to which electric charge is given, simultaneously with the jetting, according to an information signal. The charged ink particles are deflected in accordance with the quantity of charge while the particles are passing through between the deflected electrode plates. There is another system called the microdot ink-jet system, wherein the above technique is utilized. In this system, the ink pressure and oscillating conditions are maintained respectively within a suitable range, thereby ejecting ink droplets in two different sizes from the tip of the nozzle and the smaller ink droplets only are used for the recording. A special merit of this system is that finer ink droplets can be produced with a nozzle having as large a diameter as nozzles used conventionally.

The third is the piezo element system wherein the pressure-applying means for the ink is not such a mechanical one as a pump used in other systems but a piezo element. That is, this system comprises applying an electric signal to the piezo element to cause mechanical displacement of the element, thereby pressurizing the ink and jetting it from the nozzle.

The ink-jet system described in Japanese Patent Application Laid-Open No. 59936/79 can also be utilized effectively. In this system, an ink in a nozzle is subjected to the action of thermal energy to undergo an abrupt change in the volume and is ejected from the nozzle by the action of this volume change.

Various ink-jet recording systems as explained above are all applicable to the cloth printing process of the present invention. By employing any one of these systems, patterns of letters, figures, and the like can be formed by colored ink compositions on surfaces of cloths having the foregoing specific construction. According to the process of the invention, ink droplets applied to cloths are quickly absorbed and held in the ink-receiving layers of the cloths before spreading excessively. Therefore, as stated above, precise patterns can be formed and the prints will be in a state similar to dryness in several seconds after the ink application, so that continuous operation of printing is possible and the printed cloths can be immediately piled up or wound up.

Consequently, distinct and fine patterns can be formed also through a subsequent fixing treatment such as heat treatment, if necessary. In contrast to this, on conventional cloths, fine patterns are not easily formed due to the ink spreading caused on the fabrics by use of low-viscosity inks.

Figures 1, 2, 3:
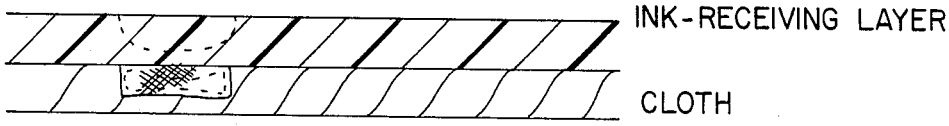
Figures 1, 2, 3, 4:
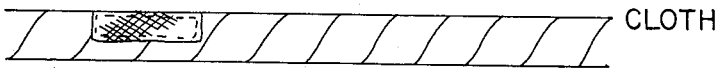

According to the process of the present invention, ink compositions can adhere, in the manner described above, onto cloths in accordance with image signals. Since dyes in ink compositions are absorbed in this stage merely in the ink-receiving material layers laid on fabric surfaces and the like, it is preferable to subject the prints subsequently to fixing treatment such as heat treatment (see FIG. 1-3). Generally, the fixing treatment is optionally selected from the processes of steaming with superheated steam, heat treatment with warm or hot water, dry heating, and soaping with an aqueous surfactant solution depending on the kinds of the cloths. Dyes are fixed satisfactorily on fibers of the fabrics by such fixing treatment and the ink-receiving material is washed out by soaping or the like (see FIG. 1-4), thus yielding printed fabrics of superior quality.

According to the present invention, it is therefore unnecessary to fabricate such high-cost printing plates as for the common cloth printing of the prior art, and the printing image can be simply prepared and revised by means of a computor, so that changes in fashion can be readily met at any time without requiring such an expensive printing plate as in the prior art. Consequently, sufficient profits can be secured even in a small scale of production without relying upon massproduction. Moreover, the present inventive process therefore has the advantage of applicability not only to industrial printing but also to home printing as a hobby or the like.

The present invention is illustrated in more detail with reference to the following examples. In these examples, parts and percents are all based on weight.

EXAMPLE 1

Ink (A)

| | |
|---|---|
| Direct dye (C.I. Direct Yellow 86) | 4 parts |
| Nonionic surfactant RHEODOL TW-L120, supplied by Kao Corporation | 0.1 part |
| Ethylene glycol | 15 parts |
| Diethylene glycol | 10 parts |
| Polyethylene glycol 300 | 3 parts |
| Water | 68 parts |

These components were all mixed to form a solution and then the insoluble matter was removed with a filter of 1 μm pore size to give an ink (A).

Ink-receiving layer solution (A)

| | |
|---|---|
| Kuraray Poval 117 (polyvinyl alcohol supplied by Kuraray K.K.) | 10 parts |
| Polyvinylpyrrolidone | 20 parts |
| Water | 70 parts |

These components were all mixed to give a uniform ink-receiving layer solution (A), which had a viscosity of about 2200 cp at 25° C. A piece of broadcloth of 100% cotton was dipped in the ink-receiving layer solution (A) and then lightly squeezed to remove an excess of the solution. This cloth was superposed on a commercial a sheet of commercial paper for report writing to facilitate the feed of the cloth to a printer, and was fed to an ink-jet printer BJ-80 (tradename, a bubble jet printer, supplied by Canon K.K.) in which thermal energy is utilized, and then test patterns were printed with ink (A) on the cloth.

The applied ink was fixed by ironing and then the ink-receiving layer solution was removed with a neutral detergent. Thus, a print (A) was obtained on a cloth by an ink-jet printer.

EXAMPLE 2

Ink (B)

| | |
|---|---|
| Reactive dye (tradename: Cibacron Red B, supplied by Ciba-Geigy GmbH) | 6 parts |
| Diethylene glycol diethyl ether | 20 parts |
| Water | 70 parts |

From all these components, an ink (B) was prepared similarly to the ink (A) of Example 1.

Ink-receiving layer solution (B)

| | |
|---|---|
| Adeka Polyether SC-800 (a sucrose-based propylene oxide adduct supplied by Asahi Denka Kogyo K.K.) | 50 parts |
| Water | 50 parts |

These components were mixed to prepare an ink-receiving layer solution (B).

This solution (B) was applied on a shirt cloth of 65% cotton and 35% hemp by means of a bar coater. The cloth was then dried in hot air at 80° C. for 1 hour to prepare a cloth ready for printing. Used Adeka Polyether SC-800 had a viscosity of about 15,000 cp at 25° C.

The cloth ready for printing was printed with ink (B) by using an ink-jet printer PJ-1080A (supplied by Canon K.K. with 4 nozzles of 65 μm size), in which thermal energy is utilized. Then the cloth was ironed to fix the ink, and washed with a neutral detergent, giving a print (B).

COMPARATIVE EXAMPLE 1

A print (C) was obtained according to the procedure of Example 1 except for using the following ink-receiving layer solution (C) in place of the ink-receiving layer solution (A).

Ink-receiving layer solution (C)

| | |
|---|---|
| Polyethylene glycol 300 | 30 parts |
| Glycerol | 60 parts |
| Water | 10 parts |

This solution (C) had a viscosity of about 600 cp at 25° C.

COMPARATIVE EXAMPLE 2

A print (D) was obtained according to the procedure of Example 2 except for using the following ink-receiving layer solution (D) in place of ink-receiving layer solution (B).

Ink-receiving layer solution (D)

| | |
|---|---|
| Noigen ET127 (polyoxyethylene alkyl ether supplied by Daiichi Kogyo Seiyaku CO., LTD.) | 50 parts |
| Water | 20 parts |

Used Noigen ET 127 had a viscosity of about 800 cp at 25° C.

Table 1 shows the evaluation of the printed cloth of Examples 1 and 2 and Comparative Examples 1 and 2.

TABLE 1

| | Degree of resolution*1 | Density*2 |
|---|---|---|
| Example 1 | Good. No blurring nor feathering observed. | 0.83 |
| Example 2 | Good. No blurring nor feathering observed. | 1.12 |
| Comparative Example 1 | Inferior. Much feathering observed appeared. The lines seen dimly. | 0.78 |
| Comparative Example 2 | Inferior. The lines not discriminated. | 0.72 |

*1Straight lines were printed at 5 mm intervals on the cloth, and the degree of resolution was judged by visual observation.
*2The found O.D. value of solid-printed area of about 2 cm square on the cloth.

EXAMPLE 3

Ink (2A)

| | |
|---|---|
| Disperse dye (C.I. Disperse Red 11) | 3.0 parts |
| Nonionic surfactant-RHEDOL TW-L120 (tradename, supplied by Kao Corporation) | 0.5 part |
| Ethylene glycol | 30 parts |
| Water | 65 parts |

These components were all mixed to a sufficiently dispersed state and then coarse particles were removed with a filter of 10 μm pore size to give an ink (2A).

Ink-receiving layer solution (2A)

| | |
|---|---|
| Kuraray Poval 117 (polyvinyl alcohol supplied by Kuraray Co., Ltd.) | 10 parts |
| Polyvinylpyrrolidone | 20 parts |
| Water | 70 parts |

These components were all mixed to form a homogeneous ink-receiving layer solution (2A). This solution had a viscosity of about 2200 cp at 25° C. A white cloth of 100% polyester was dipped in the ink-receiving layer solution (2A) and then lightly squeezed to remove an excess of the solution. This cloth was superposed on a sheet of commercial paper for report writing to facilitate the feed of the cloth to a printer. Immediately thereafter, prescribed patterns were printed with ink (2A) on the cloth by using an ink-jet printer PJ-1080A (supplied by Canon K.K. with 4 nozzles of 65 μm size) employing piezo elements.

Then the applied ink was fixed by steaming and then the cloth was subjected to soaping. Thus, a print (2A) was obtained which is a cloth printed by an ink-jet printer.

EXAMPLE 4

Ink (2B)

| | |
|---|---|
| Disperse dye (C.I. Disperse Blue 58) | 4 parts |
| Demol N (anionic surfactant consisting of a naphthalenesulfonic acid-formalin | 2 parts |

-continued

| | |
|---|---|
| condensate supplied by Kao Corporation) | |
| Diethylene glycol | 25 parts |
| Water | 70 parts |

From all these components, an ink (2B) was prepared in the same manner as in the ink (2A) of Example 3.

Ink-receiving layer solution (2B)

| | |
|---|---|
| Adeka Polyether SC-800 (a sucrose-based propylene oxide adduct supplied by Asahi Denka Kogyo K.K.) | 50 parts |
| Water | 50 parts |

These components were mixed to prepare an ink-receiving layer solution (2B). This solution (2B) was applied on a shirt cloth of 60% polyester and 40% cotton by means of a bar coater. The cloth was then dried in hot air at 80° C. for 1 hour to prepare a cloth ready for printing. Adeka Polyether SC-800 used had a viscosity of about 15,000 cp at 25° C.

The cloth ready for printing was printed with ink (2B) by using an ink-jet printer PJ-1080A (supplied by Canon K.K. employing 4 nozzles of 65 μm size), in which thermal energy is utilized. Then the cloth was ironed to fix the ink, and washed with a neutral detergent, giving a print (2B).

COMPARATIVE EXAMPLE 3

A print (2C) was obtained according to the procedure of Example 3 except for using the following ink-receiving layer solution (2C) in place of ink-receiving layer solution (2A).

Ink-receiving layer solution (2C)

| | |
|---|---|
| Polyethylene glycol 300 | 30 parts |
| Glycerol | 60 parts |
| Water | 10 parts |

This solution (2C) had a viscosity of about 600 cp at 25° C.

COMPARATIVE EXAMPLE 4

A print (2D) was obtained according to the procedure of Example 4 except for using the following ink-receiving layer solution (2D) in place of ink-receiving layer solution (2B).

Ink-receiving layer solution (2D)

| | |
|---|---|
| Noigen ET 127 (polyoxyethylene alkyl ether supplied by Daiichi Kogyo Seiyaku CO., LTD.) | 50 parts |
| Water | 50 parts |

Noigen ET 127 used had a viscosity of about 800 cp at 25° C.

Table 2 shows evaluation of the printed cloths of Examples 3 and 4 and Comparative Example 3 and 4.

TABLE 2

| | Degree of resolution*3 | Density*4 |
|---|---|---|
| Example 3 | Good. Feathering scarcely observed. | 0.65 |
| Example 4 | Good. Feathering scarcely observed. | 0.72 |
| Comparative Example 3 | Inferior. The lines being obscure and not discriminated | 0.50 |
| Comparative Example 4 | Inferior. The line being obscure and not discriminated | 0.53 |

*3Straight lines were printed at 5 mm intervals on the cloth, and the degree of resolution was judged by visual observation.
*4The found O.D. value of solid-printed area of 2 cm square on the cloth.

What is claimed is:

1. A cloth printing process, comprising:
applying a layer of a water-soluble resin or a hydrophilic resin-containing solution onto said cloth;
printing on said solution layer using an aqueous ink, said ink containing a water-soluble or disperse dye, said ink being applied using an ink-jet system, wherein said solution layer is moist and has a viscosity of 1000–15000 cp at 25° C.; and
fixing said ink to said cloth.

2. The process of claim 1, wherein the water-soluble resin or hydrophilic resin-containing solution has a viscosity of from 3000–15000 cp at 25° C.

3. The process of claim 1, wherein the water-soluble resin or hydrophilic resin-containing solution is applied as a layer having a thickness of from 0.5–30 μm.

4. The process of claim 1, wherein the water content in the water-soluble resin or hydrophilic resin-containing solution is not more than 80% by weight.

5. The process of claim 1, wherein the water-soluble resin or hydrophilic resin-containing solution layer also contains an ink absorption-improving filler material.

* * * * *